US011559833B2

(12) United States Patent
Hu et al.

(10) Patent No.: US 11,559,833 B2
(45) Date of Patent: Jan. 24, 2023

(54) DYNAMIC STRAIGHTENING METHOD FOR LEFT/RIGHT TILT

(71) Applicant: Taiyuan University of Science and Technology, Taiyuan (CN)

(72) Inventors: Ying Hu, Taiyuan (CN); Xuan Wen, Taiyuan (CN); Yan Cheng, Taiyuan (CN); Jianyun Yan, Taiyuan (CN); Xiaogang Wang, Taiyuan (CN); Peng Hu, Taiyuan (CN); Ziliang Li, Taiyuan (CN)

(73) Assignee: TAIYUAN UNIVERSITY OF SCIENCE AND TECHNOLOGY

( * ) Notice: Subject to any disclaimer, the term of this patent is extended or adjusted under 35 U.S.C. 154(b) by 214 days.

(21) Appl. No.: 17/035,230

(22) Filed: Sep. 28, 2020

(65) Prior Publication Data

US 2021/0354183 A1 Nov. 18, 2021

(30) Foreign Application Priority Data

May 14, 2020 (CN) ..... 202010405744.7

(51) Int. Cl.
*B21D 1/02* (2006.01)
*B21C 51/00* (2006.01)

(52) U.S. Cl.
CPC ..... *B21D 1/02* (2013.01); *B21C 51/00* (2013.01)

(58) Field of Classification Search
CPC ..... B21D 1/02; B21C 51/00; B21B 37/28; B21B 38/02; B21B 2263/00; B21B 2263/02; B21B 2263/04; G05B 19/40931; G05B 19/40932; G06F 30/00; G06F 30/10
USPC ..... 72/10.1, 160, 164, 165
See application file for complete search history.

(56) References Cited

U.S. PATENT DOCUMENTS 3,499,306 A * 3/1970 Pearson ..... B21B 38/02 72/21.5
4,262,511 A * 4/1981 Boisvert ..... B21B 37/32 72/31.07
4,269,051 A * 5/1981 Clarke ..... B21B 37/28 72/8.7
4,537,050 A * 8/1985 Bryant ..... B21B 37/32 72/201

(Continued)

*Primary Examiner* — Shelley M Self
*Assistant Examiner* — Teresa A Guthrie
(74) *Attorney, Agent, or Firm* — Edmonds & Cmaidalka, P.C.

(57) ABSTRACT

A dynamic straightening method for a left/right tilt. The method includes: drawing an unevenness curve according to a distance from a shapemeter to a surface of a plate, where there are a plurality of unevenness curves; using a barycentric formula to obtain a first barycentric coordinate of each unevenness curve; calculating a tilt value of a straightening roll corresponding to each unevenness curve according to the first barycentric coordinate of each unevenness curve; determining an unevenness curve of a current straightening roll; adjusting the straightening roll according to the tilt value of the straightening roll corresponding to the unevenness curve, to straighten the plate; and going back to the step of determining an unevenness curve of a current straightening roll until the plate is totally straightened. Such method improves plate straightening accuracy by dynamically adjusting parameters of the straightening roll.

8 Claims, 6 Drawing Sheets

(56) References Cited

U.S. PATENT DOCUMENTS

| | | | | |
|---|---|---|---|---|
| 4,809,527 | A * | 3/1989 | Mitchell | B21B 38/02<br>72/31.07 |
| 5,361,386 | A * | 11/1994 | Watkins | G06T 15/80<br>345/647 |
| 7,475,581 | B2 * | 1/2009 | Farnik | B21D 1/02<br>702/158 |
| 10,573,070 | B1 * | 2/2020 | Tristano | G06F 30/00 |
| 2006/0067571 | A1 * | 3/2006 | Onishi | G06T 7/001<br>382/149 |

* cited by examiner

DYNAMIC STRAIGHTENING METHOD FOR LEFT/RIGHT TILT

CROSS-REFERENCE TO RELATED APPLICATIONS

This application claims priority to Chinese Patent Application having serial number 202010405744.7, filed on May 14, 2020. The entirety of which is incorporated by reference herein.

BACKGROUND OF THE INVENTION

Field of the Invention

The present invention relates to the technical field of plate straightening, and in particular, to a dynamic straightening method for a left/right tilt.

Description of the Related Art

In the production process, steel plates, especially composite plates, special steel plates, etc, cannot fully release internal residual stresses, resulting in various plate defects. Existing straightening processes cannot achieve dynamic adjustment according to specific plate defects, and thus cannot meet increasing high-precision straightening requirements.

SUMMARY OF THE INVENTION

An objective of the present invention is to provide a dynamic straightening method for a left/right tilt, to achieve dynamic adjustment according to specific plate defects.

To achieve the above objectives, the present invention provides the following technical solutions.

In one particular embodiment, a dynamic straightening method for a left/right tilt includes drawing an unevenness curve according to a distance from a shapemeter to a surface of a plate, where there are a plurality of unevenness curves; using a barycentric formula to obtain a first barycentric coordinate of each unevenness curve; calculating a tilt value of a straightening roll corresponding to each unevenness curve according to the first barycentric coordinate of each unevenness curve; determining an unevenness curve of a current straightening roll; adjusting the straightening roll according to the tilt value of the straightening roll corresponding to the unevenness curve, to straighten the plate; and going back to the step of determining an unevenness curve of a current straightening roll until the plate is totally straightened.

The present invention can further obtain a barycentric coordinate of each unevenness curve through the unevenness curve of the plate, to obtain the tilt value of the straightening roll corresponding to each curve, and then adjusts the tilt value of the straightening roll according to the unevenness curve of the straightening roll. In this way, the present invention achieves dynamic adjustment of the straightening parameters according to the plate defect characteristics, and improves the straightening accuracy. The present invention further provides the following technical effects described in more detail below.

BRIEF DESCRIPTION OF THE DRAWINGS

To describe the technical solutions in the embodiments of the present invention or in the prior art more clearly, the following briefly describes the accompanying drawings required for the embodiments. A person of ordinary skill in the art may still derive other accompanying drawings from these accompanying drawings without creative efforts.

In said FIGS. 1-9, where referenced, E refers to a shapemeter; F refers to a base level; M refers to a straightening direction; G refers to a standard line; H refers to a head; J refers to a tail; O refers to a region, and P refers to a number of an unevenness characteristic curve.

DETAILED DESCRIPTION

The following clearly and completely describes the technical solutions in the embodiments of the present invention with reference to the accompanying drawings in the embodiments of the present invention. All other embodiments obtained by a person of ordinary skill in the art based on the embodiments of the present invention without creative efforts shall fall within the protection scope of the present invention.

An objective of the present invention is to provide a dynamic straightening method for a left/right tilt, to achieve dynamic adjustment according to specific plate defects. In order to make the above objectives, features, and advantages of the present invention more apparent, the present invention will be further described in detail in connection with the accompanying drawings and the detailed description.

Figure 1:
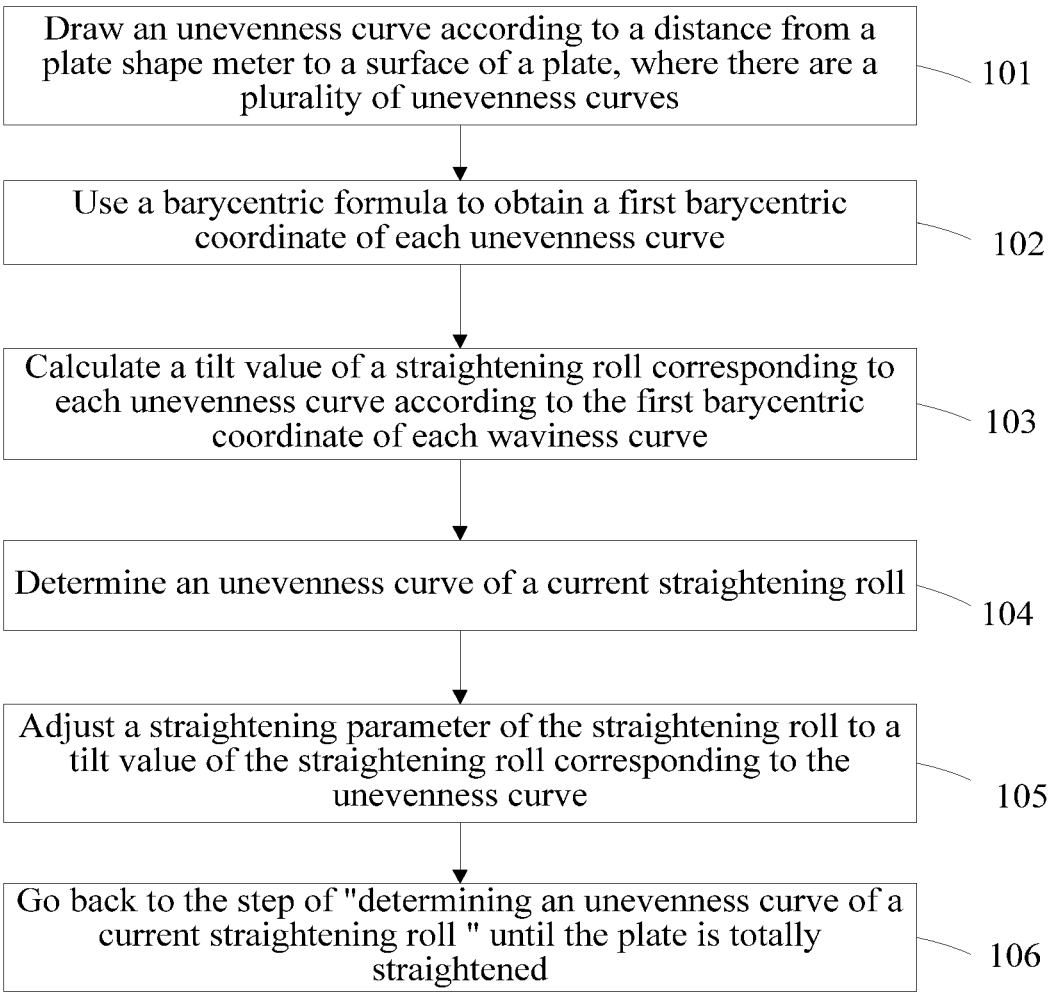
FIG. 1 is a flow chart of a method according to the present invention.

As shown in FIG. 1, the dynamic straightening method for a left/right tilt includes the following steps:

Step 101: drawing an unevenness curve according to a distance from a shapemeter to a surface of a plate, where there are a plurality of unevenness curves;

Step 102: using a barycentric formula to obtain a first barycentric coordinate of each unevenness curve;

Step 103: calculating a tilt value of a straightening roll corresponding to each unevenness curve according to the first barycentric coordinate of each unevenness curve;

Step 104: determining an unevenness curve of a current straightening roll;

Step 105: adjusting a straightening parameter of the straightening roll to a tilt value of the straightening roll corresponding to the unevenness curve; and Step 106: going back to the step of "determining an unevenness curve of a current straightening roll" until the plate is totally straightened.

Figure 2:
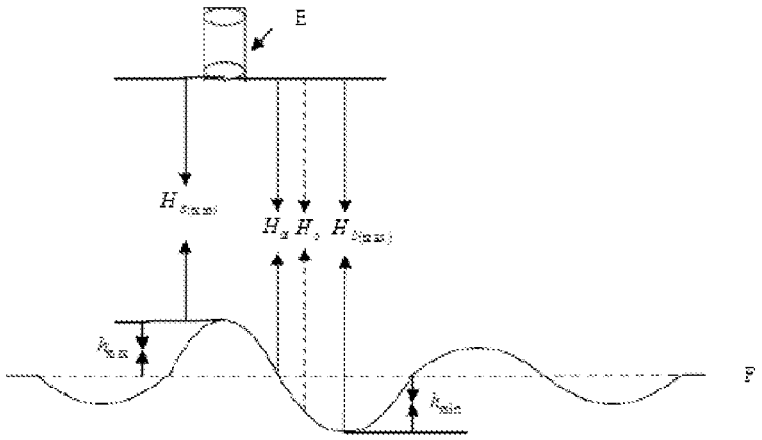
FIG. 2 is a schematic diagram of measuring unevenness h of a plate according to one or more embodiments of the present invention.

Step 101 specifically includes: as shown in FIG. 2, obtaining a distance $H_a$ from the shapemeter to the base level of the plate; measuring the distance $H_b$ from the shapemeter to the surface of the plate every a fixed value Δx along the surface of the plate by using the shapemeter; calculating a difference h between $H_a$ and $H_b$, where h is unevenness of the plate, a maximum value of h is defined as $h_{max}$, and a minimum value of h is defined as $h_{min}$; and dividing a range of $h_{min}$ to $h_{max}$ into a plurality of numerical ranges at an interval of a fixed value Δh, drawing measurement points in a same numerical range into an unevenness curve, and establishing a two-dimensional coordinate system with an initial measurement point of the shapemeter as an origin, a width direction of the plate as an x-axis, and a length direction of the plate as a y-axis, to mark two-dimensional coordinates of all measurement points located on a same unevenness curve.

Figure 3:
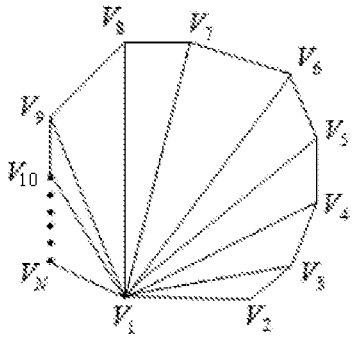
FIG. 3 is a schematic diagram of approximating an unevenness curve as an irregular N polygon according to one or more embodiments of the present invention.

Step 102 specifically includes as shown in FIG. 3, approximating the unevenness curve as an irregular N polygon, selecting one vertex $V_1$ of the irregular N polygon, connecting the vertex $V_1$ with all non-adjacent vertexes $V_3$, $V_4, \ldots, V_{N-1}$, and dividing the irregular N polygon into N−2 triangles; respectively calculating a barycentric coordinate of the N−2 triangles by using a formula $c_x=(x_1+x_2+x_3)/3$; $c_y=(y_1+y_2+y_3)/3$, where $c_x$ is a horizontal axis of each triangle barycentric coordinate, $c_y$ is a vertical axis of each triangle barycentric coordinate, $x_1$, $x_2$, $x_3$ is a horizontal axis of three vertexes of each triangle, and $y_1$, $y_2$, $y_3$ is a vertical axis of three vertexes of each triangle; respectively calculating areas of the N−2 triangles by using a formula $s=|[(x_2-x_1)*(y_3-y_1)-(x_3-x_1)*(y_2-y_1)]/2|$, where s is an area of each triangle, $x_1$, $x_2$, $x_3$ is the horizontal axis of three vertexes of each triangle, and $y_1$, $y_2$, $y_3$ is the vertical axis of three vertexes of each triangle; and calculating the first barycentric coordinate of each unevenness curve according to the barycentric coordinate and the area, where the specific method includes: calculating the first barycentric coordinate of the unevenness curve by using a formula $$x = \left(\frac{\sum_{i=1}^{N-2} c_x[i]s[i]}{\sum_{i=1}^{N-2} s[i]}\right), y = \left(\frac{\sum_{i=1}^{N-2} c_y[i]s[i]}{\sum_{i=1}^{N-2} s[i]}\right),$$

where x is a horizontal axis of the first barycentric coordinate, y is a vertical axis of the first barycentric coordinate, $c_x[i]$ is a horizontal axis of a $i^{th}$ triangle barycentric coordinate, $c_y[i]$ is a vertical axis of a $i^{th}$ triangle barycentric coordinate, and s[i] is an area of a $i^{th}$ triangle.

Figure 5:
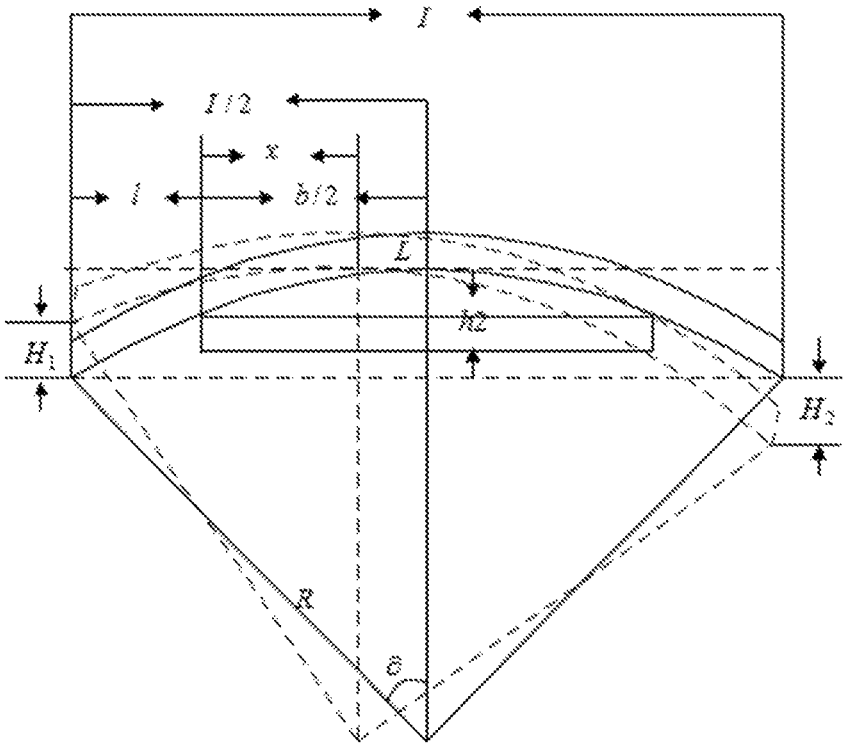
FIG. 5 is a schematic diagram in which a straightening roll is tilted to the right according to one or more embodiments of the present invention.
Figure 6:
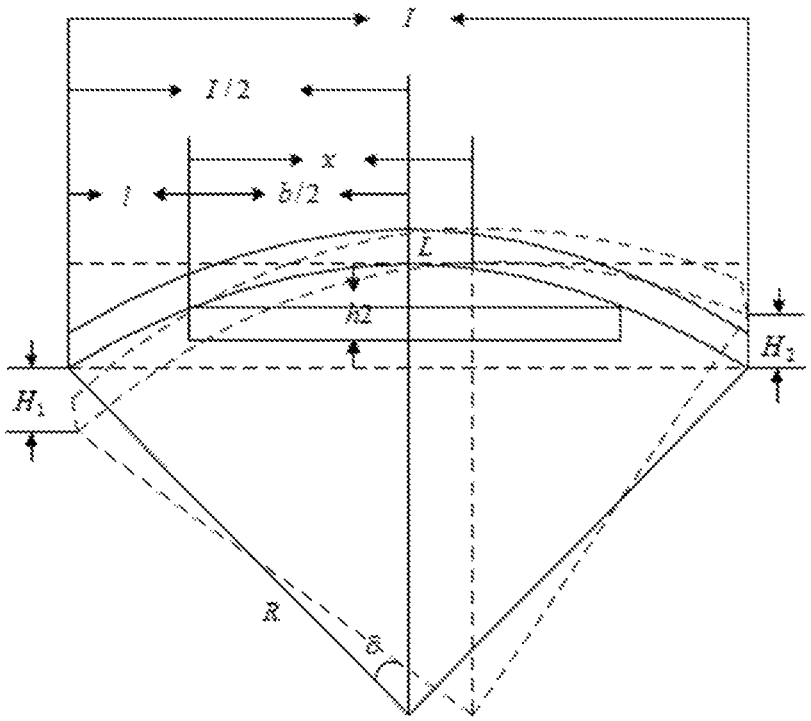
FIG. 6 is a schematic diagram in which a straightening roll is tilted to the left according to one or more embodiments of the present invention.

Step 103 includes: determining a position of plate defect according to the distribution of the barycenter, making a highest point of the straightening roll and the barycenter of the plate defect on a same vertical line by tilting the straightening roll, thereby straightening the plate, and the specific step includes: obtaining a bending roll's adjustable range pr, an actual length L of the straightening roll, and a width b of the plate, where the height h2 of the straightening roll is equal to pr; because a highest point of an initial straightening roll is located in the center of the straightening roll, obtaining a highest point position of the straightening roll and left and right end points of the straightening roll, where the three points respectively are A, B, and C, two points of A and B are taken as a perpendicular bisector, other two points of A and C (or B and C) are taken as a perpendicular bisector, and an intersection point of the two perpendicular bisectors is a center of a circle, thus forming a sector with a radius of R and a central angle of 2∂, as shown in FIG. 5 and FIG. 6; and then successively performing the following steps: (a) establishing a mathematical relationship of the sector with respect to h2, R, and ∂, and substituting the roll height h2 into the mathematical relationship, to calculate R and ∂; (b) calculating a second barycentric coordinate of each unevenness curve according to the first barycentric coordinate, R, ∂, and b of the unevenness curve; and (c) calculating a tilt value of the straightening roll according to the second barycentric coordinate.

Figure 4:
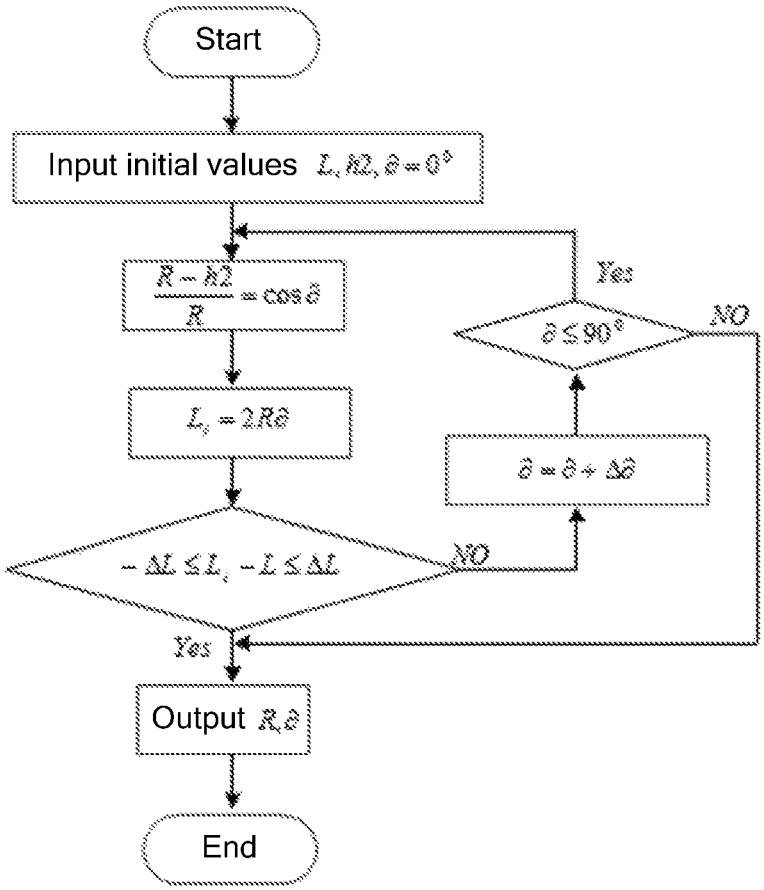
FIG. 4 is a flow chart of a method for calculating R and ∂ according to one or more embodiments of the present invention.

According to FIG. 5 and FIG. 6, the mathematical relationship with respect to h2, R, and ∂ can be obtained as:

$$\frac{R-h2}{R} = \cos\partial \tag{1}$$

$$L_i = 2R\partial \quad (0 \le \partial \le 90°) \tag{2}$$

where $L_i$ is the length of the straightening roll, h2 is the height of the roll, R is the radius of the sector, and ∂ is half of the central angle of the sector; and A specific calculating process of the above formulas (1) and (2) is shown in FIG. 4: initially assumed that $\partial=0^0$, substituting ∂ into $$\frac{R-h2}{R} = \cos\partial$$

to obtain R corresponding to ∂, then substituting R and ∂ into a formula $L_i=2R\partial$ $(0\le\partial\le90^0)$ to obtain a corresponding straightening roll length $L_i$, determining whether a difference of $L_i-L$ is within a value range ±ΔL, if it is in the value range, then outputting R and ∂, otherwise determining a ∂ value every Δ∂, and going back to the step of "determining whether a difference of $L_i-L$ is within a value range ±ΔL" until outputting R and ∂.

Step (b) specifically is: During the plate putting into the straightening roll, the barycenter of the plate coincides with the center of the straightening roll, when the leftmost end of the straightening roll is used as the origin of the coordinate axis, the barycentric horizontal axis x of the plate defect position will change relative to the straightening roll, and the vertical axis will not change; and therefore, assuming that the first barycentric coordinate of the unevenness curve is (x, y), the second barycentric coordinate of the unevenness curve is (x', y) according to FIG. 5 and FIG. 6, it can be learned that:

$$l = 2R\sin\partial \tag{3}$$

$$l = \frac{l}{2} - \frac{b}{2} \tag{4}$$

$$x = x + l \tag{5}$$

Formulas (3), (4) and (5) can be used to calculate a horizontal axis of the second barycentric coordinate of the unevenness curve, where R is the radius of the sector, ∂ is half of the central angle of the sector, I is the width of the straightening roll, b is the width of the plate, l is a displacement amount of the horizontal axis x of the first barycentric coordinate, and x' is the horizontal axis of the second barycentric coordinate.

In Step (c), with reference to FIG. 5 and FIG. 6, it can be learned that:

$$H_1 = R - h2 - \sqrt{R^2 - x'^2} \quad (6)$$

$$H_2 = R - h2 - \sqrt{R^2 - (I - x')^2} \quad (7)$$

Formulas (6) and (7) can be used to calculate the tilt value of the straightening roll, where $H_1$ is a rising or falling value of a leftmost end of the straightening roll, R is the radius of the sector, h2 is the height of the roll, x' is the horizontal axis of the second barycentric coordinate, I is the width of the straightening roll, and $H_2$ is a rising or falling value of a rightmost end of the straightening roll, then determining a relationship between x' and I/2:

if x'<I/2, the straightening roll is tilted to the right, $H_1$ a negative value, and $H_2$ is a positive value; if x'=I/2, the straightening roll is not tilted, $H_1$ and $H_2$ are zero; or if x'>I/2, the straightening roll is tilted to the left, $H_1$ is a positive value, and $H_2$ is a negative value, where the negative value represents an upward direction and the positive value represents a downward direction.

Figure 7:
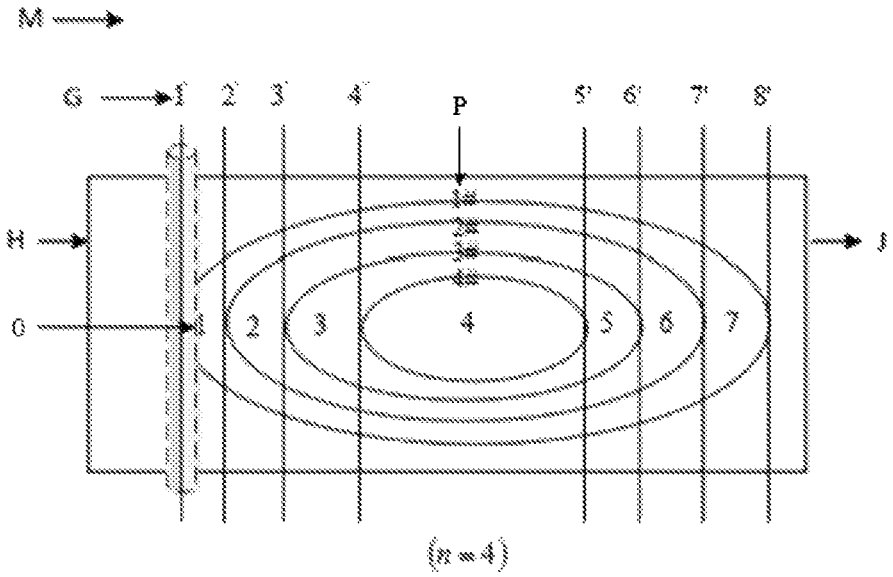
FIG. 7 is a totally enclosed unevenness curve diagram according to one or more embodiments of the present invention.

The specific parameter setting method of steps 104 to 106 is:

(1) As shown in FIG. 7, when the unevenness curve diagram is in a totally closed state, a standard line is drawn along the surface of the plate at the initial nip point and the straightening end point of each unevenness curve, where G represents the standard line. From this, 2n standard lines can be drawn, where n is the quantity of unevenness curves, and these 2n standard lines divide the unevenness curve diagram into 2n~1 regions. When the head of the plate first enters the straightening roll, the parameters of the straightening roll acting on 1~n regions are set to the tilt value corresponding to the 1#~n# unevenness curves, and the parameters of the straightening roll gradually acting on n+1_2n−1 regions are set to the tilt value corresponding to the (n−1)#~1# unevenness curves. When the tail of the plate first enters the straightening roll, the parameters of the straightening roll acting on 2n−1_n+1 regions are set to the tilt value corresponding to the 1#~(n−1)# unevenness curve, and the parameters of the straightening roll gradually acting on n~1 regions are set to the tilt value corresponding to the n#~1# unevenness curve.

Figure 8:
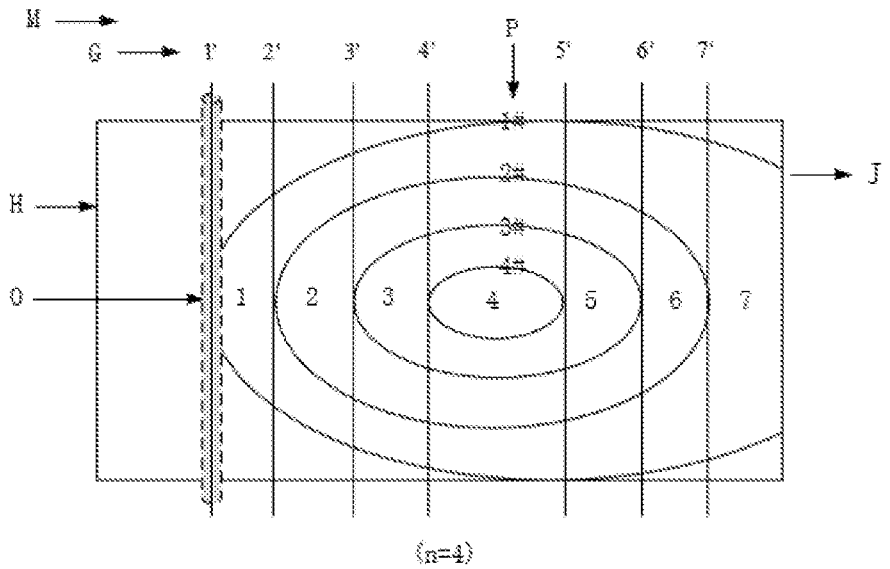
FIG. 8 is a semi-closed unevenness curve diagram according to one or more embodiments of the present invention.
Figure 9:
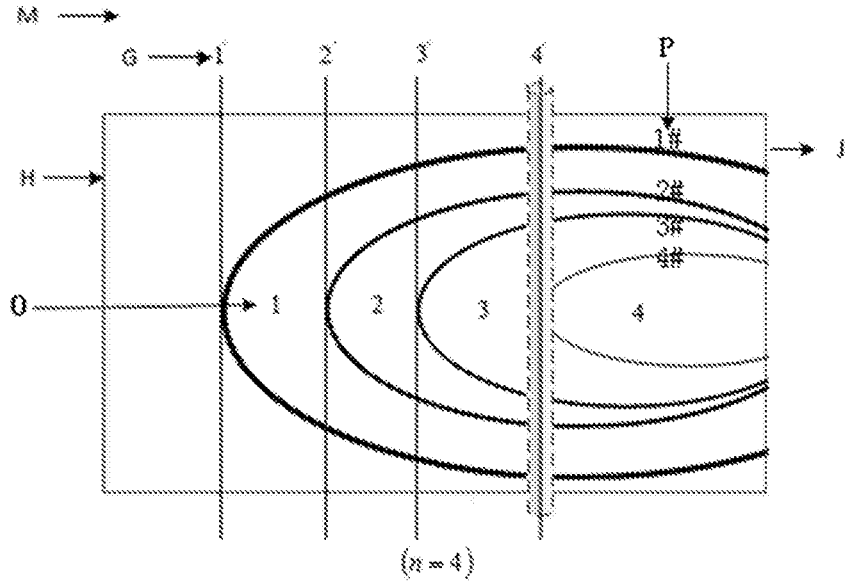
FIG. 9 is an open unevenness curve diagram according to one or more embodiments of the present invention.

(2) when the unevenness curve diagram is in a semi-closed or totally unclosed state, where the semi-closed state is as shown in FIG. 8 and the totally unclosed state is as shown in FIG. 9, a standard line is drawn at each of the initial put point and the straightening end point of the closed unevenness curves, and a standard line is drawn only at the initial put point of the unclosed unevenness curve. If m (m≥n) standard lines are totally drawn, it can be divided into m regions, and when the unevenness curve diagram is in a totally unclosed state, m=n. When the head of the plate first enters the straightening roll, the parameters of the straightening roll acting on 1_n regions are set to the tilt value corresponding to the 1#~n# unevenness curves, and the parameters of the straightening roll gradually acting on n+1_m regions are set to the tilt value corresponding to the (n−1)#~(2n−m)# unevenness curves. When the tail of the plate first enters the straightening roll, the parameters of the straightening roll acting on m_n+1 regions are set to the tilt value corresponding to the (2n−m)#~(n−1)# unevenness curve, and the parameters of the straightening roll gradually acting on n~1 regions are set to the tilt value corresponding to the n#~1# unevenness curve.

The present invention also discloses the following technical effects.

The present invention obtains a barycentric coordinate of each unevenness curve through the unevenness curve of the plate, to obtain the tilt value of the straightening roll corresponding to each unevenness curve, and adjusts the tilt value of the straightening roll according to the unevenness curve of the straightening roll. In this way, the present invention achieves dynamic adjustment of the straightening parameters according to the plate defect characteristics, and improves the straightening accuracy.

Each embodiment of the specification is described in a progressive manner, each embodiment focuses on the difference from other embodiments, and the same and similar parts between the embodiments may refer to each other. For a person of ordinary skill in the art, according to the concepts of the present invention, there may be modifications in the specific implementation and application scope. In conclusion, the content of the specification shall not be construed as a limitation to the present invention.

What is claimed is:

1. A dynamic straightening method for a left/right tilt comprising:

drawing a plurality of unevenness curves according to a distance from a shapemeter to a surface of a plate, comprising:

obtaining a distance $H_a$ from the shapemeter to a base level of the plate;

measuring a distance $H_b$ from the shapemeter to the surface of the plate at each of measurement points spaced apart by a fixed distance value Δx along directions of an x-axis and an y-axis in the surface of the plate by using the shapemeter, wherein a two-dimensional coordinate system is established with an initial measurement point of the shapemeter as an origin, a width direction of the plate as the x-axis, and a length direction of the plate as the y-axis;

calculating a difference h between $H_a$ and $H_b$, wherein h is unevenness of the plate, a maximum value of h is defined as $h_{max}$, and a minimum value of h is defined as $h_{min}$; and dividing a range from $h_{min}$ to $h_{max}$ into a plurality of sub-ranges with a same interval value of Δh, drawing an unevenness curve by connecting measurement points in a same sub-range, and obtaining two-dimensional coordinates of all measurement points located on a same unevenness curve;

calculating a first barycentric coordinate of each unevenness curve by using a barycentric formula;

calculating for each unevenness curve, a tilt value of a straightening roll according to the first barycentric coordinate of each unevenness curve;

determining a current unevenness curve at which the straightening roll is positioned;

adjusting the straightening roll according to a tilt value of the straightening roll corresponding to the current unevenness curve, to straighten the plate;

moving the plate through the straightening roll; and going back to the step of determining a current unevenness curve at which the straightening roll is positioned, until the plate is totally straightened.

2. The dynamic straightening method for a left/right tilt according to claim 1, wherein the calculating a first barycentric coordinate of each unevenness curve by using a barycentric formula comprises:

approximating the unevenness curve as an irregular N polygon;

selecting one vertex of the irregular N polygon, connecting the vertex with all non-adjacent vertexes, and dividing the irregular N polygon into N−2 triangles;

respectively calculating barycentric coordinates of the N−2 triangles;

respectively calculating areas of the N−2 triangles; and calculating the first barycentric coordinate of the unevenness curve according to the barycentric coordinates and the areas.

3. A dynamic straightening method for a left/right tilt comprising:

drawing a plurality of unevenness curves according to a distance from a shapemeter to a surface of a plate;

calculating a first barycentric coordinate of each unevenness curve by using a barycentric formula;

calculating for each unevenness curve, a tilt value of a straightening roll according to the first barycentric coordinate of each unevenness curve;

determining a current unevenness curve at which the straightening roll is positioned;

adjusting the straightening roll according to a tilt value of the straightening roll corresponding to the current unevenness curve, to straighten the plate;

moving the plate through the straightening roll;

going back to the step of determining a current unevenness curve at which the straightening roll is positioned, until the plate is totally straightened; and wherein the calculating for each unevenness curve, a tilt value of a straightening roll according to the first barycentric coordinate of each unevenness curve comprises:

obtaining a height h2 of the straightening roll, an actual length L of the straightening roll, and a width b of the plate;

obtaining a highest point position of the straightening roll and left and right end points of the straightening roll, wherein the three points respectively are denoted as A, B, and C, a first perpendicular bisector is drawn between two points A and B, a second perpendicular bisector is drawn between two points A and C or between two points B and C, and an intersection point of the first perpendicular bisector and the second perpendicular bisector is a center of a circle, thus forming a sector with a radius of R and a central angle of 2∂;

establishing a mathematical relationship among h2 and R, and ∂ of the sector, and substituting the roll height h2 into the mathematical relationship, to calculate R and ∂;

calculating a second barycentric coordinate of the unevenness curve according to the first barycentric coordinate, R, ∂, and b of the unevenness curve; and calculating the tilt value of the straightening roll according to the second barycentric coordinate.

4. A dynamic straightening method for a left/right tilt comprising:

drawing a plurality of unevenness curves according to a distance from a shapemeter to a surface of a plate;

calculating a first barycentric coordinate of each unevenness curve by using a barycentric formula, comprising approximating the unevenness curve as an irregular N polygon;

selecting one vertex of the irregular N polygon, connecting the vertex with all non-adjacent vertexes, and dividing the irregular N polygon into N−2 triangles;

respectively calculating barycentric coordinates of the N−2 triangles;

respectively calculating areas of the N−2 triangles; and calculating the first barycentric coordinate of the unevenness curve according to the barycentric coordinates and the areas;

calculating for each unevenness curve, a tilt value of a straightening roll according to the first barycentric coordinate of each unevenness curve;

determining a current unevenness curve at which the straightening roll is positioned;

adjusting the straightening roll according to a tilt value of the straightening roll corresponding to the current unevenness curve, to straighten the plate;

moving the plate through the straightening roll;

going back to the step of determining a current unevenness curve at which the straightening roll is positioned, until the plate is totally straightened; and wherein the calculating the first barycentric coordinate of the unevenness curve according to the barycentric coordinates and the areas comprises:

calculating the first barycentric coordinate of the unevenness curve by using a formula $$x = \left( \frac{\sum_{i=1}^{N-2} c_x[i]s[i]}{\sum_{i=1}^{N-2} s[i]} \right), \quad y = \left( \frac{\sum_{i=1}^{N-2} c_y[i]s[i]}{\sum_{i=1}^{N-2} s[i]} \right),$$

wherein x is a horizontal axis of the first barycentric coordinate, y is a vertical axis of the first barycentric coordinate, $c_x[i]$ is a horizontal axis of a barycentric coordinate of an i th triangle, $c_y$ [i] is a vertical axis of the barycentric coordinate of the i th triangle, and s[i] is an area of the i th triangle.

5. The dynamic straightening method for a left/right tilt according to claim 3, wherein the establishing a mathematical relationship among h2 and R, and ∂ of the sector, and substituting the roll height h2 into the mathematical relationship, to calculate R and ∂ comprises:

establishing the mathematical relationship among h2 and R, and ∂ of the sector as:

$$\frac{R-h2}{R} = \cos\partial$$

$$L_i = 2R\partial \quad (0 \le \partial \le 90^0)$$

wherein $L_i$ is the length of the straightening roll, h2 is the height of the roll, R is the radius of the sector, and ∂ is half of the central angle of the sector; and performing the following calculation process to obtain R and ∂: initially assumed that $\partial=0^0$, substituting ∂ into $$\frac{R-h2}{R} = \cos\partial$$

to obtain R corresponding to ∂, then substituting R and ∂ into a formula $L_i=2R\partial$ ($0\leq\partial\leq 90^0$) to obtain a corresponding length $L_i$ of the straightening roll, determining whether a difference of $L_i-L$ within a value range $\pm\Delta L$, if it is in the value range, then outputting R and ∂, otherwise incrementing a value of ∂ by Δ∂, and going back to the step of substituting ∂ into $$\frac{R-h2}{R}=\cos\partial$$

to obtain R corresponding to ∂ until outputting R and ∂.

6. The dynamic straightening method for a left/right tilt according to claim 3, wherein the calculating a second barycentric coordinate of the unevenness curve according to the first barycentric coordinate, R, ∂, and b of the unevenness curve comprises:

deeming the first barycentric coordinate of the unevenness curve as (x, y), and the second barycentric coordinate of the unevenness curve as (x, y); and using formulas I=2R sin ∂, $$l=\frac{I}{2}-\frac{b}{2},$$

and x'=x+l to calculate a horizontal axis of the second barycentric coordinate of the unevenness curve, wherein R is the radius of the sector, ∂ is half of the central angle of the sector, I is the width of the straightening roll, b is the width of the plate, l is a displacement amount of the horizontal axis x of the first barycentric coordinate, and x' is the horizontal axis of the second barycentric coordinate.

7. The dynamic straightening method for a left/right tilt according to claim 3, wherein the calculating the tilt value of the straightening roll according to the second barycentric coordinate comprises:

using formulas $$H_1=R-h2-\sqrt{R^2-x'^2}\ \text{ and }\ H_2=R-h2-\sqrt{R^2-(I-x')^2}$$

to calculate the tilt value of the straightening roll, wherein $H_1$ is a rising or falling value of a leftmost end of the straightening roll, R is the radius of the sector, h2 is the height of the straightening roll, x' is the horizontal axis of the second barycentric coordinate, I is the width of the straightening roll, and $H_2$ is a rising or falling value of a rightmost end of the straightening roll; and comparing x' with $$\frac{I}{2}:$$

if $$x'<\frac{I}{2},$$

the straightening roll is tilted to the right, $H_1$ is a negative value, and $H_2$ is a positive value;

if $$x'=\frac{I}{2},$$

the straightening roll is not tilted, $H_1$ and $H_2$ are zero; or if $$x'>\frac{I}{2},$$

the straightening roll is tilted to the left, $H_1$ is a positive value, and $H_2$ is a negative value.

8. The dynamic straightening method for a left/right tilt according to claim 1, wherein the adjusting the straightening roll according to a tilt value of the straightening roll corresponding to the current unevenness curve, to straighten the plate specifically comprises:

determining whether each unevenness curve is totally enclosed, semi-closed, or open;

drawing standard lines according to the unevenness curves;

dividing the unevenness curves into a plurality of regions according to the standard lines, wherein respective regions correspond to respective tilt values of the straightening roll; and straightening the plate according to the tilt value of the straightening roll.

* * * * *